US006664733B2

(12) United States Patent
Harada et al.

(10) Patent No.: US 6,664,733 B2
(45) Date of Patent: Dec. 16, 2003

(54) ELECTRODE FOR DISCHARGE TUBE, AND DISCHARGE TUBE USING IT

(75) Inventors: Nobuharu Harada, Hamamatsu (JP); Syoji Ishihara, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 09/912,384

(22) Filed: Jul. 26, 2001

(65) Prior Publication Data

US 2001/0052755 A1 Dec. 20, 2001

Related U.S. Application Data

(63) Continuation-in-part of application No. PCT/JP00/00383, filed on Jan. 26, 2000.

(30) Foreign Application Priority Data

Jan. 26, 1999 (JP) ..... P11-017300

(51) Int. Cl.[7] ..... H01J 17/04

(52) U.S. Cl. ..... 313/631; 313/632; 313/331; 313/336

(58) Field of Search ..... 313/631, 632, 313/331, 333, 283, 481, 336, 332, 326, 620, 623, 628, 625; 445/26, 23

(56) References Cited

U.S. PATENT DOCUMENTS 5,604,405 A * 2/1997 Ogura ..... 315/302

FOREIGN PATENT DOCUMENTS

| | | |
|---|---|---|
| JP | 61-233960 | 10/1986 |
| JP | 62-241254 | 10/1987 |
| JP | 63-119130 | 5/1988 |
| JP | 2-189852 | 7/1990 |
| JP | 4-3388 | 2/1992 |

* cited by examiner

*Primary Examiner*—Vip Patel
*Assistant Examiner*—Ken A Berck
(74) *Attorney, Agent, or Firm*—Morgan, Lewis & Bockius LLP

(57) ABSTRACT

A discharge tube is comprised of a glass bulb, a cathode, and an anode. Impregnating porous tungsten with barium makes the cathode tip portion. A clearance between the end face of a lead rod and the end face of the cathode tip portion is filled with a molybdenum-ruthenium brazing filler metal.

9 Claims, 4 Drawing Sheets

ELECTRODE FOR DISCHARGE TUBE, AND DISCHARGE TUBE USING IT

RELATED APPLICATION

This is a continuation-in-part application of application Ser. No. PCT/JP00/00383 filed on Jan. 26, 2000, now pending.

BACKGROUND OF THE INVENTION

1. Field of the Invention

The present invention relates to an electrode for discharge tube, and a discharge tube using it.

2. Related Background Art

Discharge tubes are commonly used as light sources for illumination and instrumentation. The discharge tubes are light sources in which a cathode and an anode are included opposite to each other in a discharge gas atmosphere and in which arc discharge is induced between the cathode and the anode. Such discharge tubes are provided, for example, with the electrode as disclosed in Japanese Utility Model No. H04-3388. This electrode is one having such structure that the tip of a refractory metal rod is covered by an impregnated electrode of a cap shape obtained by impregnating a porous refractory metal with an electron-emissible substrate. When the discharge tube is constructed using the electrode of the porous refractory metal impregnated with the electron-emissible substance as in the case of the above electrode, the discharge tube becomes able to emit electrons readily and suffers less damage at the tip.

SUMMARY OF THE INVENTION

However, the above discharge tube, particularly, the above electrode used in the discharge tube, had the following problem. Since the above electrode uses a rodlike member, i.e., the refractory metal rod as a base section of the electrode, the contact area is small between the impregnated electrode as a main body of the electrode and the refractory metal rod, so that heat transfer efficiency is considerably low between the impregnated electrode and the refractory metal. Therefore, the heat generated in the impregnated electrode is not dissipated efficiently.

In order to solve this problem, it can be considered to employ an electrode with increased heat radiation efficiency in such structure that the base section of the electrode is provided with an end face having a projection and that the projection is placed in an insert hole of the main body of the electrode, so as to increase the contact area between the base section and the main body of the electrode.

Even in the structure of the above electrode, however, there is a small clearance between the base section and the main body of the electrode and the heat radiation efficiency is not satisfactory. With existence of such a clearance, the electron-emitting (or -emissible) substance remaining in this clearance will evaporate with arise in temperature during operation of the discharge tube to be deposited on the wall surface of the discharge tube. As a result, the discharge tube will decrease its quantity of output light, and the life of the discharge tube will be shortened.

It is, therefore, an object of the present invention to solve the above problem and provide a discharge tube with high heat radiation efficiency and with a long life and a discharge tube electrode used therein.

In order to accomplish the above object, an electrode for discharge tube according to the present invention is a discharge tube electrode used in a discharge tube in which a cathode and an anode are included opposite to each other in a discharge gas atmosphere and in which arc discharge is induced between the cathode and the anode, the electrode comprising a base section made of a refractory metal and having an end face provided with a projection, and a main body made of a refractory metal containing an electron-emissible substance, having a cusp at one end thereof, and having an end face provided with an insert hole to accommodate the projection of the base section, at another end, wherein a clearance between the end face of the base section and the end face of the main body is sealed with a brazing filler metal.

When the projection of the base section is fitted in the insert hole of the main body, the end face of the base section provided with the projection comes to face the end face of the main body provided with the insert hole. Since the clearance between the end face of the base section and the end face of the main body is sealed with the brazing filler metal, the heat transfer efficiency is increased between the main body and the base section. Since the clearance between the end face of the base section and the end face of the main body is sealed with the brazing filler metal, the electron-emissible substance is prevented from entering the clearance from the outside, and even if the electron-emissible substance bleeds out of the main body into the clearance the electron-emissible substance will be prevented from being emitted from the clearance to the outside.

In the discharge tube electrode of the present invention, the brazing filler metal may be filled in the clearance.

When the clearance is filled with the brazing filler metal, the heat transfer efficiency is further increased between the main body and the base section through the brazing filler metal.

In the discharge tube electrode of the present invention, the end face of the base section may be larger than the end face of the main body.

When the end face of the base section is greater than the end face of the main body, the heat radiation efficiency of the main body is increased.

In the discharge tube electrode of the present invention, the brazing filler metal may be provided so as to extend from the clearance to a side face of the main body.

When the brazing filler metal is provided so as to extend from the clearance to the side face of the main body, the electron-emissible substance bleeding out of the side face of the main body is prevented from being emitted to the outside.

In the discharge tube electrode of the present invention, the main body may be comprised of an impregnated metal made by impregnating a porous refractory metal with an electron-emissible substance.

When the main body is comprised of the impregnated metal obtained by impregnating the porous refractory metal with the electron-emissible substance, the electron-emissible substance becomes uniformly included in the main body, so as to enhance uniformity of output light. For making the main body contain the electron-emissible substance by impregnation, the main body is normally impregnated with the electron-emissible substance after the projection of the base section is inserted into the insert hole of the main body. Since the clearance between the end face of the base section and the end face of the main body is sealed with the brazing filler metal, the electron-emissible substance is also prevented from entering the clearance during the impregnation with the electron-emissible substance.

In the discharge tube electrode of the present invention, the brazing filler metal may be a material having a melting point lower than those of the main body and the base section and higher than an impregnation temperature for the impregnation of the main body with the electron-emissible substance.

When the brazing filler metal is the material having the melting point lower than those of the main body and the base section, the shapes of the main body and the base section are maintained even during the sealing operation of the clearance by heating to melt the brazing filler metal. Since the brazing filler metal is the material having the melting point higher than the impregnation temperature, the brazing filler metal is prevented from evaporating or deforming during the impregnation.

In the discharge tube electrode of the present invention, the brazing filler metal may be a molybdenum (Mo)-ruthenium (Ru) brazing filler metal.

In the discharge tube electrode of the present invention, the electron-emissible substance may comprise a simple substance or an oxide of an alkaline earth metal.

When the electron-emissible substance is a simple substance or an oxide of an alkaline earth metal, it becomes feasible to effectively decrease the work function of the main body.

The discharge tube electrode of the present invention may further comprise a coating of a refractory metal for covering the surface of the main body while exposing the tip of the cusp of the main body.

With provision of such a coating, the electron-emissible substance bleeding out of the side face of the main body can be prevented more effectively from evaporating to the outside.

In order to accomplish the above object, a discharge tube of the present invention is a discharge tube in which a cathode and an anode are included opposite to each other in a discharge gas atmosphere and in which arc discharge is induced between the cathode and the anode, wherein at least one of the cathode and the anode is either of the discharge tube electrodes described above.

When the discharge tube is constructed using either of the above electrodes, the electron-emissible substance is prevented from going from the outside into the clearance between the end face of the base section and the end face of the main body, and even if the electron-emissible substrate bleeds out of the main body into the clearance the electron-emissible substance will be prevented from being emitted from the clearance to the outside.

DESCRIPTION OF THE PREFFERED EMBODIMENTS

A discharge tube according to an embodiment of the present invention will be described with reference to the drawings. A discharge tube electrode according to an embodiment of the present invention is included in the discharge tube of the present embodiment.

Figure 1:
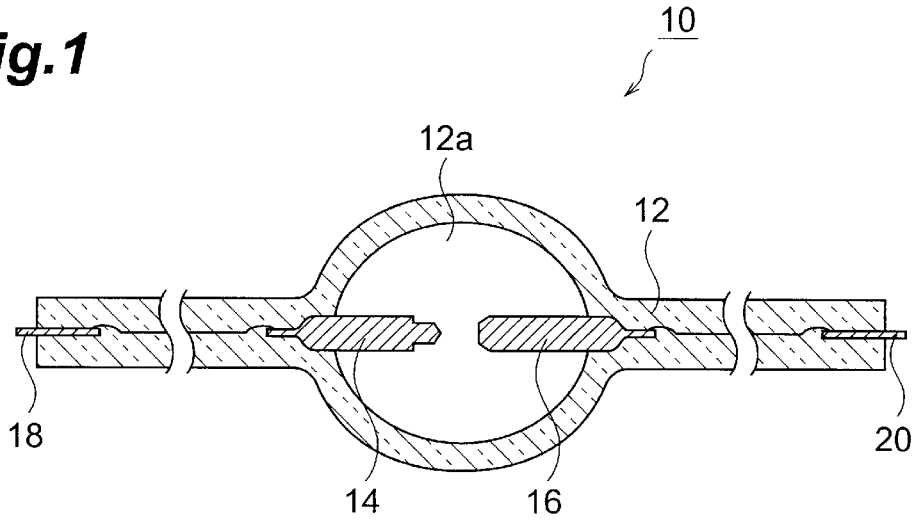
FIG. 1 is a cross-sectional view of a discharge tube.

First, the structure of the discharge tube according to the present embodiment will be described. FIG. 1 is a cross-sectional view of the discharge tube according to the present embodiment. The discharge tube 10 of the present embodiment is provided with a glass bulb 12, a cathode 14, and an anode 16.

The glass bulb 12 is made of quartz and has a substantially rodlike shape. A hollow gas enclosure 12*a* is formed in an intermediate portion of the glass bulb 12 and a discharge gas, e.g. xenon, is confined inside this enclosure. Inside the gas enclosure 12*a*, there are the cathode 14 and the anode 16 placed opposite to each other. The cathode 14 and the anode 16 are electrically connected to external terminals 18, 20, respectively, disposed at the two ends of the glass bulb 12. When a voltage is placed between the cathode 14 and the anode 16 through the external terminals 18, 20, arc discharge is generated between the cathode 14 and the anode 16, so as to emit light.

Figure 2:
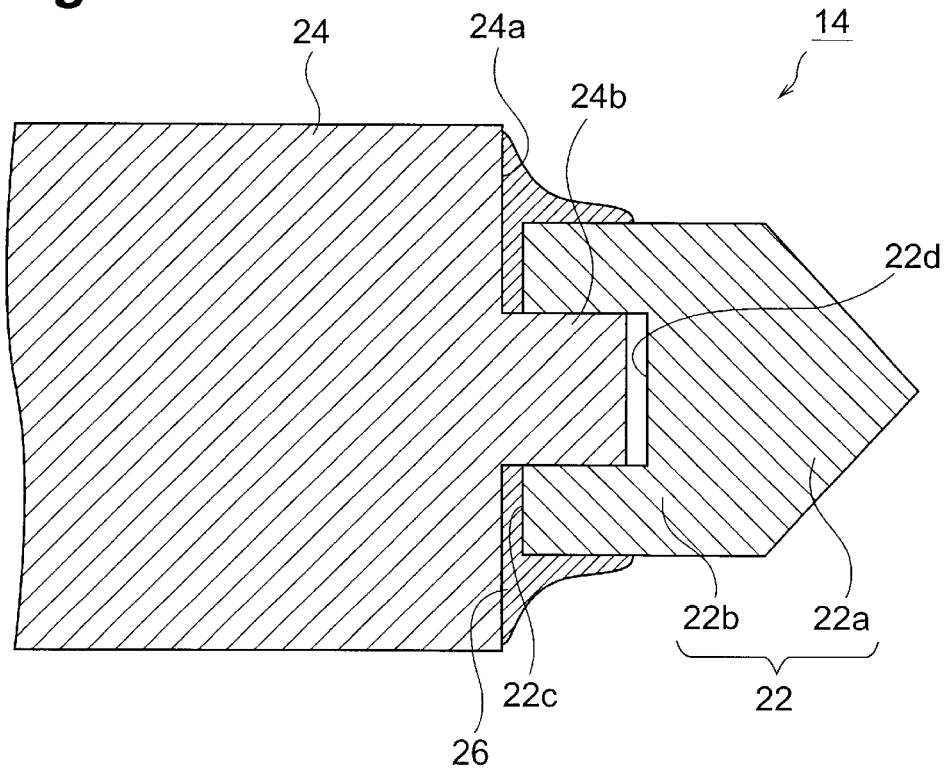
FIG. 2 is a cross-sectional view of an electrode.

FIG. 2 is a cross-sectional view of the cathode 14, which is one of the electrodes. The cathode 14 is comprised of a cathode tip portion 22 (main body) and a lead rod 24 (base section). The lead rod 24 is made of molybdenum (refractory metal) and has a cylindrically extending shape. A cylindrical projection 24*b* is formed on one end face 24*a* of the lead rod 24.

The cathode tip portion 22 is made by impregnating porous tungsten (refractory metal) with barium (electron-emitting (or -emissible) substance). The impregnation of barium being an alkaline earth metal can decrease the work function of the cathode tip portion 22 to facilitate emission of electrons. The cathode tip portion 22 has a bullet shape consisting of a conical cusp 22*a* provided on one end side to face the anode 16 and a cylindrical base 22*b* provided on the other end side. Particularly herein, a cylindrical insert hole 22*d* to accommodate the projection 24*b* of the lead rod 24 is formed in an end face 22*c* of the base 22*b*.

The projection 24*b* of the lead rod 24 is fitted in the insert hole 22*d* of the cathode tip portion 22, so that the end face 24*a* of the lead rod 24 faces the end face 22*c* of the cathode tip portion 22. Particularly herein, the end face 24*a* of the lead rod 24 is larger than the end face 22*c* of the cathode tip portion 22. The outside diameter of the projection 24*b* of the lead rod 24 is substantially equal to the inside diameter of the insert hole 22*d* of the cathode tip portion 22 and the lead rod 24 is coupled with the cathode tip portion 22 by pressing the projection 24*b* of the lead rod 24 into the insert hole 22*d* of the cathode tip portion 22.

The clearance between the end face 24*a* of the lead rod 24 and the end face 22*c* of the cathode tip portion 22 is sealed with the Mo—Ru brazing filler metal 26, so as to isolate the clearance from the outside. More specifically, the Mo—Ru brazing filler metal 26 is filled in the clearance and the Mo—Ru brazing filler metal 26 is further provided so as to extend up to over a part of the end face 24*a* of the lead rod 24 not facing the end face 22*c* of the cathode tip portion 22 and up to over the side face of the cathode tip portion 22. Here, particularly, the melting point of the Mo—Ru brazing filler metal 26 is 1950° and is thus lower than the melting point of tungsten (3410° C.) as a material of the cathode tip portion 22 and the melting point of molybdenum (2620° C.) as a material of the lead rod 24 and higher than the impregnation temperature (about 1500° C.) for the impregnation of barium into the cathode tip portion 22.

The anode 16 is made of tungsten and has a shape in which a tip portion of a frustum of circular cone provided on one end side to face the cathode 14 is connected to a cylindrical base, as illustrated in FIG. 1.

In the next place, a method of fabricating the cathode 14, which is one characteristic portion of the discharge tube according to the present embodiment, will be described.

Figure 3A:
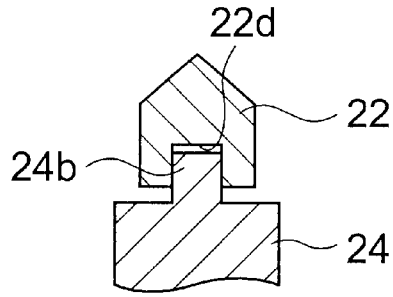
FIG. 3A, FIG. 3B, FIG. 3C, and FIG. 3D are fabrication step diagrams of the electrode.

FIG. 3A to FIG. 3D are step diagrams to show fabrication steps of the cathode 14. For fabricating the cathode 14, as illustrated in FIG. 3A, the projection 24*b* formed on the end face 24*a* of the lead rod 24 is first pressed into and fixed in the insert hole 22*d* formed in the end face 22*c* of the cathode tip portion 22.

Figure 3B:
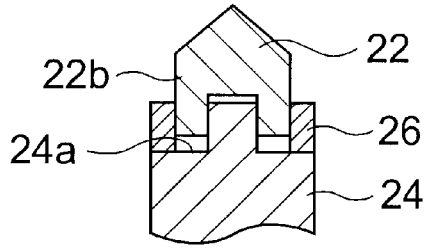

After that, as illustrated in FIG. 3B, the Mo—Ru brazing filler metal 26 formed in a tubular shape is placed so as to contact both the periphery of the base 22*b* of the cathode tip portion 22 and the end face 24*a* of the lead rod 24.

Figure 3C:
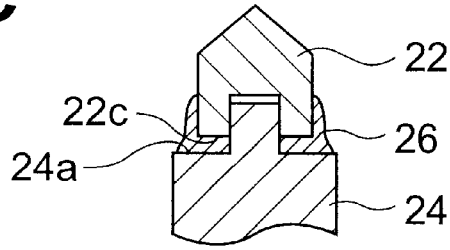

Thereafter, the Mo—Ru brazing filler metal 26 is heated whereby the clearance between the end face 24*a* of the lead rod 24 and the end face 22*c* of the cathode tip portion 22 is filled with the Mo—Ru brazing filler metal 26, as illustrated in FIG. 3C. By adequately controlling the amount of the Mo—Ru brazing filler metal 26, the Mo—Ru brazing filler metal 26 can be provided so as to extend up to over the part of the end face 24*a* of the lead rod 24 not facing the end face 22*c* of the cathode tip portion 22 and up to over the side face of the cathode tip portion 22. Since the melting points of the materials making the cathode tip portion 22 and the lead rod 24 are higher than the melting point of the Mo—Ru brazing filler metal 26, the cathode tip portion 22 and the lead rod 24 are prevented from undergoing thermal deformation during the heating process to melt the Mo—Ru brazing filler metal 26.

Figure 3D:
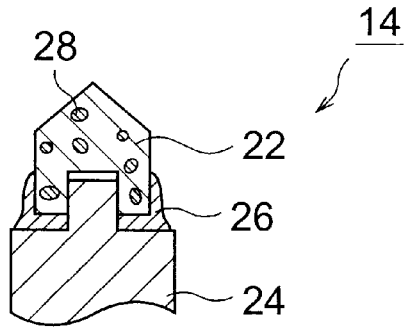

After that, as illustrated in FIG. 3D, the cathode tip portion 22 is impregnated with barium 28 under an atmosphere of about 1500° C. Since the melting point of the Mo—Ru brazing filler metal 26 is higher than the impregnation temperature, the Mo—Ru brazing filler metal 26 is prevented from evaporating or deforming during the impregnation of barium 28. Since the cathode tip portion 22 is made to include barium 28 as an electron-emissible substance by the impregnation, barium 28 becomes uniformly included in the cathode tip portion 22, so as to enhance uniformity of output light.

In the next place, the action and effect of the discharge tube according to the present embodiment will be described. The discharge tube 10 of the present embodiment is constructed in such structure that in the cathode 14 the clearance between the end face 24*a* of the lead rod 24 and the end face 22*c* of the cathode tip portion 22 is sealed with the Mo—Ru brazing filler metal 26 and, particularly, the clearance is sealed by filling the Mo—Ru brazing filler metal 26 into the clearance. Accordingly, the electron-emissible substance of barium or the like is prevented from going from the outside into the clearance. Therefore, even if there is a rise in the ambient temperature during the operation of the discharge tube 10, the electron-emissible substance will be prevented from evaporating and attaching to the wall surface of the discharge tube 10. As a result, it becomes feasible to maintain the quantity of output light of the discharge tube 10 well over a long period and thus extend the life of the discharge tube 10.

In the discharge tube 10 of the present embodiment, the Mo—Ru brazing filler metal 26 is further provided so as to extend up to over the part of the end face 24*a* of the lead rod 24 not facing the end face 22*c* of the cathode tip portion 22 and up to over the side face of the cathode tip portion 22. Accordingly, even if the electron-emissible substance bleeds out of the side face of the base 22*b* of the cathode tip portion 22, the electron-emissible substance will be prevented from being emitted to the outside. As a result, it becomes feasible to further extend the life of the discharge tube.

Figure 4:
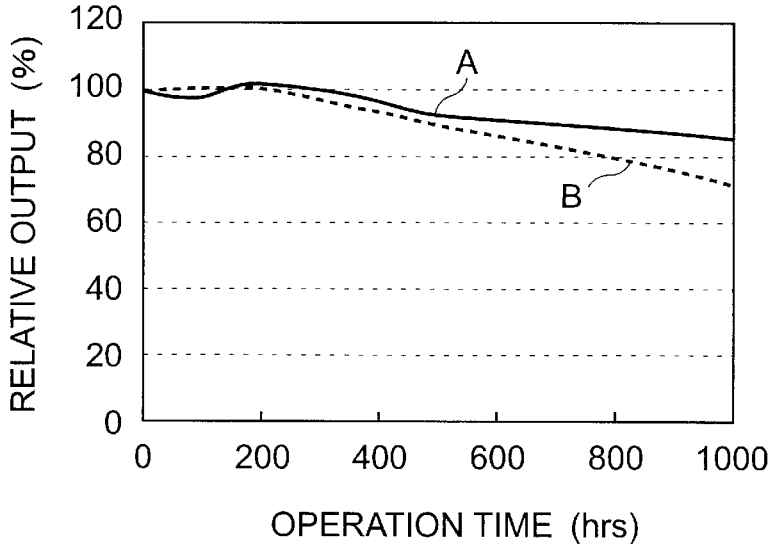
FIG. 4 is a graph to show temporal changes in output of discharge tubes.

FIG. 4 is a graph to show temporal changes in output from the discharge tube 10 of the present embodiment (indicated by A in FIG. 4) and from a discharge tube as a comparative object (indicated by B in FIG. 4). Here the discharge tube of the comparative object is a discharge tube having the cathode in which the clearance between the end face of the lead rod and the end face of the cathode tip portion is not filled with the Mo—Ru brazing filler metal. As apparent from FIG. 4, the discharge tube of the comparative object decreases its light output to about 70% of the initial output after 1000-hour operation, whereas the discharge tube 10 of the present embodiment is able to maintain the light output over 80% of the initial output even after 1000-hour operation.

Further, in the discharge tube 10 of the present embodiment the clearance between the end face 24*a* of the lead rod 24 and the end face 22*c* of the cathode tip portion 22 is sealed with the Mo—Ru brazing filler metal 26 and, particularly, the clearance is filled with the Mo—Ru brazing filler metal 26 whereby the heat transfer efficiency is increased between the cathode tip portion 22 and the lead rod 24 through the Mo—Ru brazing filler metal 26. As a consequence, it becomes feasible to radiate the heat generated in the cathode tip portion 22 effectively into the lead rod 24 and thus effectively prevent a rise in the temperature of the discharge tube 10. In the discharge tube 10 of the present embodiment, particularly, the end face 24*a* of the lead rod 24 is greater than the end face 22*c* of the cathode tip portion 22, thereby increasing the heat radiation efficiency of the cathode tip portion 22.

In the discharge tube 10 of the present embodiment, the clearance between the end face 24*a* of the lead rod 24 and the end face 22*c* of the cathode tip portion 22 is sealed with the Mo—Ru brazing filler metal 126 before the impregnation of the cathode tip portion 22 with the electron-emissible substance. This prevents the electron-emissible substance from entering the clearance. As a result, it becomes feasible to reduce a use amount of the electron-emissible substance.

Since the discharge tube 10 of the present embodiment is constructed in the structure in which the clearance between the end face 24*a* of the lead rod 24 and the end face 22*c* of the cathode tip portion 22 is filled with the Mo—Ru brazing filler metal 26, it becomes feasible to prevent occurrence of dispersion in the heat radiation efficiency among lots and fabricate discharge tubes with even performance.

Figure 5:
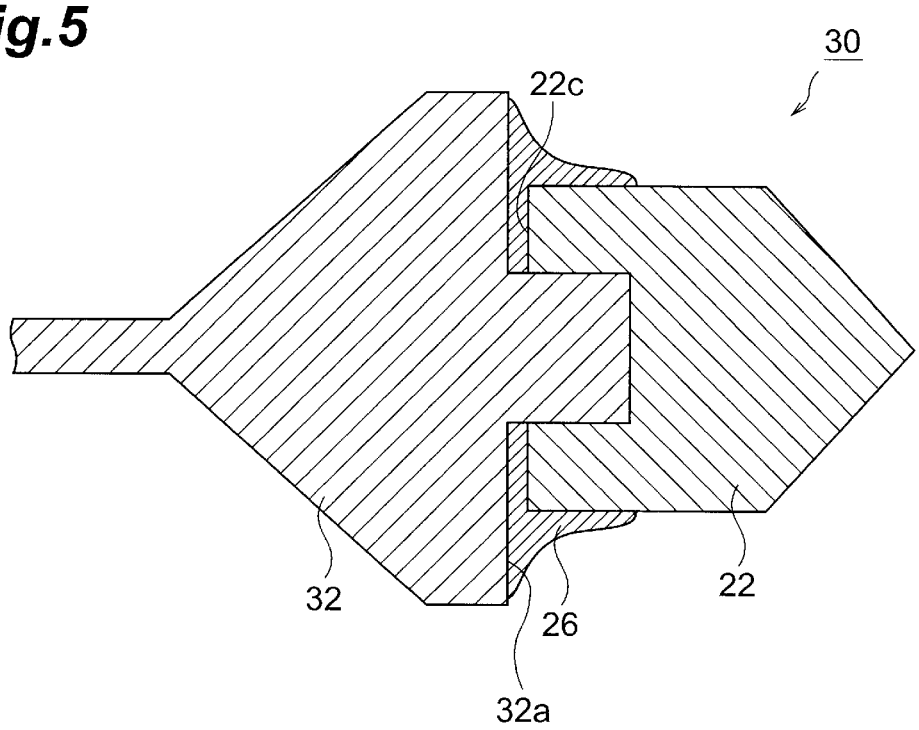
FIG. 5 is a cross-sectional view of another electrode.

The cathode of the discharge tube 10 of the above embodiment may be replaced by a cathode 30 as illustrated in FIG. 5. Namely, the lead rod 24 of the cathode 14 of the above embodiment had the cylindrical shape, whereas the lead rod 32 is of a shape having an end face 32*a* opposed to the end face 22*c* of the cathode tip portion 22 and larger than the end face 22*c* and having a rear end portion of a rodlike shape having a smaller diameter. By employing the lead rod 32 of this shape, it becomes feasible to increase the heat transfer efficiency between the cathode tip portion 22 and the lead rod 32 and effectively prevent a rise in the temperature of the discharge tube 10.

Figure 6:
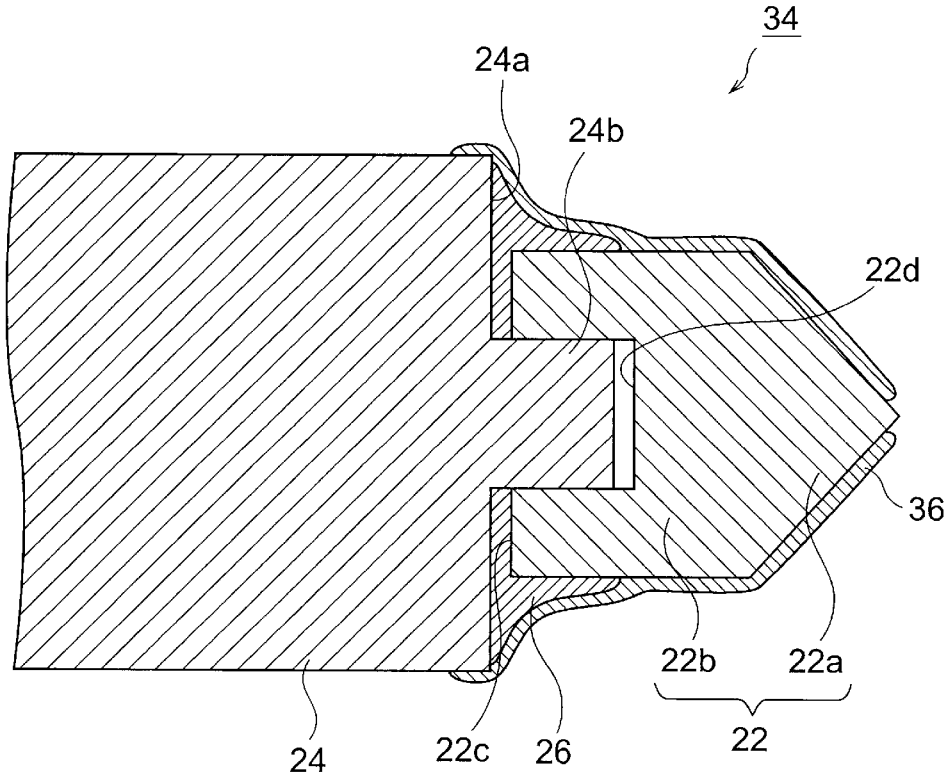
FIG. 6 is a cross-sectional view of still another electrode.

The cathode of the discharge tube 10 of the above embodiment can also be another cathode 34 as illustrated in FIG. 6. Namely, the cathode 34 is further provided with a metal coating 36 of iridium (refractory metal) for covering the surface of the cathode tip portion 22 while exposing the tip of the cusp 22*a* of the cathode tip portion 22, when compared with the cathode 14. The metal coating 36 is readily made by depositing iridium in the thickness of about 2000 Å on the surface of the cathode tip portion 22 by a CVD method, a sputtering method, or the like and thereafter removing the metal coating 36 located at the tip of the cusp 22*a* of the cathode tip portion 22 by a polishing treatment with sand paper, an ablation process with laser, or the like. The provision of the metal coating 36 makes it feasible to more effectively prevent the evaporation of the electron-emissible substance bleeding out of the side face of the cathode tip portion 22. When the metal coating 36 is provided so as to cover a wide range enough to contact the lead rod 24, the heat transfer efficiency is increased from the cathode tip portion 22 to the lead rod 24 whereby temperature increase of the discharge tube 10 can be prevented effectively.

In the discharge tube 10 of the above embodiment the cathode tip portion 22 was made of tungsten and the lead rod 24 of molybdenum, but they may also be made of other materials such as rhenium, tantalum, and soon. The material of the cathode tip portion 22 can be the same as or different from the material of the lead rod 24.

In the discharge tube 10 of the above embodiment, the electron-emissible substance was barium, but it can also be made of another material, e.g., a simple substance or an oxide of an alkaline earth metal such as calcium, strontium, or the like. The electron-emissible substance may be a mixture of two or more above simple substances or oxides.

The discharge tube 10 of the above embodiment was provided with the impregnated type cathode tip portion 22 made by impregnation of the electron-emissible substance, but it may also be replaced by a sintered type cathode tip portion obtained by simultaneously sintering powder of a refractory metal, e.g. tungsten, and powder of an electron-emissible substance, e.g. barium.

In the discharge tube 10 of the above embodiment, the clearance between the end face 24*a* of the lead rod 24 and the end face 22*c* of the cathode tip portion 22 was filled with the Mo—Ru brazing filler metal 26, but the clearance does not have to be filled everywhere without any space as long as the clearance between the end face 24*a* of the lead rod 24 and the end face 22*c* of the cathode tip portion 22 is sealed so as to be isolated from the outside.

Since in the discharge tube electrode of the present invention the end face of the base section is opposed to the end face of the main body and the clearance between them is sealed with the brazing filler metal, the heat transfer efficiency is increased between the main body and the base section. As a result, the heat radiation efficiency of the discharge tube is increased.

When the above clearance is sealed with the brazing filler metal, the electron-emissible substance is prevented from going from the outside into the clearance, and even if the electron-emissible substance bleeds out of the main body into the clearance the electron-emissible substance will be prevented from being emitted from the clearance to the outside. Accordingly, even if there is a rise in the ambient temperature during the operation of the discharge tube the electron-emissible substance will be prevented from evaporating and attaching to the wall surface of the discharge tube. As a result, it becomes feasible to maintain the quantity of output light of the discharge tube well over a long period and thus extend the life of the discharge tube.

In the discharge tube electrode of the present invention, the heat transfer efficiency can be further increased between the main body and the base section, by filling the above clearance with the brazing filler metal or by making the end face of the base section larger than the end face of the main body. As a result, it becomes feasible to effectively radiate the heat generated in the main body into the base section and effectively prevent the temperature increase of the discharge tube.

Further, since in the discharge tube electrode of the present invention the brazing filler metal is provided so as to extend from the clearance to the side face of the main body, the electron-emissible substance bleeding out of the side face of the main body is prevented from being emitted to the outside. As a result, it becomes feasible to further extend the life of the discharge tube.

What is claimed is:

1. A discharge tube electrode used in a discharge tube in which a cathode and an anode are included opposite to each other in a discharge gas atmosphere and in which arc discharge is induced between the cathode and the anode, the electrode comprising:

a base section made of a refractory metal and having an end face provided with a projection; and a main body made of a refractory metal containing an electron-emitting substance, having a cusp at one end thereof; and having an end face provided with an insert hole to accommodate said projection of said base section, at another end, wherein a clearance between said end face of said base section and said main body is sealed with a brazing filler metal, and wherein said end face of said base section is larger than said end face of said main body.

2. A discharge tube electrode used in a discharge tube in which a cathode and an anode are included opposite to each other in a discharge gas atmosphere and in which arc discharge is induced between the cathode and the anode, the electrode comprising:

a base section made of a refractory metal and having an end face provided with a projection; and a main body made of a refractory metal containing an electron-emitting substance, having a cusp at one end thereof; and having an end face provided with an insert hole to accommodate said projection of said base section, at another end, wherein a clearance between said end face of said base section and said end face of said main body is sealed with a brazing filler metal, and wherein said brazing filler metal is provided so as to extend from said clearance to a side face of said main body.

3. The discharge tube electrode according to claim 1 or 2, wherein said brazing filler metal is filled in said clearance.

4. The discharge tube electrode according to claim 1 or 2, wherein said main body is comprised of an impregnated metal made by impregnating a porous refractory metal with an electron-emitting substance.

5. The discharge tube electrode according to claim 4, wherein said brazing filler metal is comprised of a material having a melting point lower than those of said main body and said base section and higher than an impregnation temperature for the impregnation of said main body with said electron-emitting substance.

6. The discharge tube electrode according to claim 5, wherein said brazing filler metal is a molybdenum-ruthenium brazing filler metal.

7. The discharge tube electrode according to claim 1 or 2, wherein said electron-emitting substance comprises a simple substance or an oxide of an alkaline earth metal.

8. The discharge tube electrode according to claim 1 or 2, further comprising a coating of a refractory metal for covering the surface of said main body while exposing the tip of said cusp of said main body.

9. A discharge tube in which a cathode and an anode are included opposite to each other in a discharge gas atmosphere and in which arc discharge is induced between said cathode and said anode, wherein at least one of said cathode and said anode is the discharge tube electrode as set forth in claim 1 or 2.

* * * * *